US006149111A

United States Patent [19]

Epstein

[11] Patent Number: 6,149,111

[45] Date of Patent: Nov. 21, 2000

[54] COLLAPSIBLE SUPPORT DEVICE

[76] Inventor: Marc I. Epstein, 1172 Park Ave., New York, N.Y. 10128

[21] Appl. No.: 09/212,871

[22] Filed: Dec. 16, 1998

[51] Int. Cl.[7] ..... A45D 19/04

[52] U.S. Cl. ..... 248/174; 248/152; 248/535; 248/539; 40/124.06

[58] Field of Search ..... 248/174, 152, 248/459, 519, 524, 528, 535, 539; 40/214, 212, 124.06, 124.14, 124.19, 607; 446/220, 224; 206/362.4, 485

[56] References Cited

U.S. PATENT DOCUMENTS

| | | | |
|---|---|---|---|
| 1,647,154 | 11/1927 | Soybel | 211/70.1 |
| 1,713,758 | 5/1929 | Horwath | 248/152 |
| 2,282,280 | 5/1942 | Yogg | 40/124.15 |
| 2,771,260 | 11/1956 | Thom | 248/524 |
| 2,918,178 | 12/1959 | Leone | 211/95 |
| 3,050,183 | 8/1962 | Mueller, Jr. | 206/780 |
| 3,169,740 | 2/1965 | Beckett | 2448/519 |
| 3,178,138 | 4/1965 | Hessdoerfer et al. | 248/539 |
| 3,281,975 | 11/1966 | Simone | 40/120 |
| 3,532,310 | 10/1970 | Finfrock | 248/535 |
| 4,247,003 | 1/1981 | Jones | 206/486 |
| 4,770,379 | 9/1988 | Estvold | 248/110 |
| 5,010,669 | 4/1991 | Moran | 40/539 |
| 5,297,677 | 3/1994 | Burian et al. | 206/362.4 |
| 5,306,194 | 4/1994 | Epstein | 446/224 |
| 5,334,072 | 8/1994 | Epstein | 446/224 |
| 5,366,192 | 11/1994 | Carroll | 248/152 |
| 5,853,336 | 12/1998 | Hufgard | 473/282 |

*Primary Examiner*—Anita M. King
*Attorney, Agent, or Firm*—William E. Pelton, Esq.

[57] ABSTRACT

A support device includes a flexible sheet material foldable to form a three-dimensional two-sided A-frame structure having at least a pair of substantially aligned predetermined holes, one above the other and a pole-like element insertable through the vertically aligned holes and supported by the three-dimensional folded structure, the pole-like element maintaining the flexible sheet material as the three-dimensional two-sided A-frame structure when folded. The flexible sheet material is preferably a die-cut and scored piece of material such as cardboard. The holes may be formed within corresponding tab-like sections of the flexible sheet material. According to an embodiment, the three-dimensional two-sided a-frame structure is a retail point-of-purchase display sign support and the pole-like element is a support for a display sign. According to another embodiment, the three-dimensional two-sided A-frame structure is a stand for an artificial Christmas tree and the pole-like element is an artificial Christmas tree.

13 Claims, 7 Drawing Sheets

COLLAPSIBLE SUPPORT DEVICE

FIELD OF THE INVENTION

The present invention relates to collapsible support devices and in particular to foldable support devices providing three-dimensional vertical support for an elongated shaft or pole-like element.

BACKGROUND OF THE INVENTION

Most support devices providing vertical support for elongated shafts having a cylindrical or other appropriate cross section and which may be pole-like products are made of rigid metal, wood and plastic materials that are relatively expensive or difficult to produce, pack, transport or assemble; frequently requiring special tools, parts and instructions. Existing state-of-the-art collapsible support devices depend upon costly and complex multiple primary materials or secondary parts to form a three dimensional structure using a fastening method such as glue, velcro®, rivets, clips, tape and the like. Additional disadvantages of the prior types of collapsible support devices include instability, complete dependence on the lightweight base for support and potential weakness which can lead to collapse due to improperly sized or attached points of fastening.

SUMMARY OF THE INVENTION

A novel support device according to an embodiment of the present invention is formed on a die-cut and scored piece of flat, flexible sheet material, such as cardboard, which may be folded to form a three-dimensional two-sided A-frame structure having at least a pair of substantially aligned predetermined holes, one above the other. The holes may be die-cut or pre-punched prior to folding and formed within corresponding tab-like sections of the foldable sheet material. A pole-like element may be vertically supported by the three-dimensional folded structure as a result of being inserted through the vertically aligned holes. In this way the spaced apart lower edges of the A-frame sides define a stable supporting base while also retaining and immobilizing the vertical member traversing the aligned holes formed therein.

It is an object of the present invention to provide an economical, convenient, easily assembled and effective three-dimensional support device. The use of a single sheet of flat cardboard, or the like, provides easy economical packaging, shipping and storage; while also facilitating colorful design decoration, printing and shapes. The support device can be assembled and disassembled quickly without tools or parts, or extraneous fastening devices.

In a preferred embodiment of the present invention, the support device is a retail point-of-purchase display sign support; however, other uses are envisioned, such as a stand for an artificial Christmas tree, a temporary or disposable holder for indoor or outdoor signs; a stand to display a toy balloon attached to the top of a stick or straw, and the like.

BRIEF DESCRIPTION OF THE DRAWINGS

For a further understanding of the present invention, reference may be had to the accompanying drawings in which.

DESCRIPTION OF THE PREFERRED EMBODIMENTS

Figure 1:
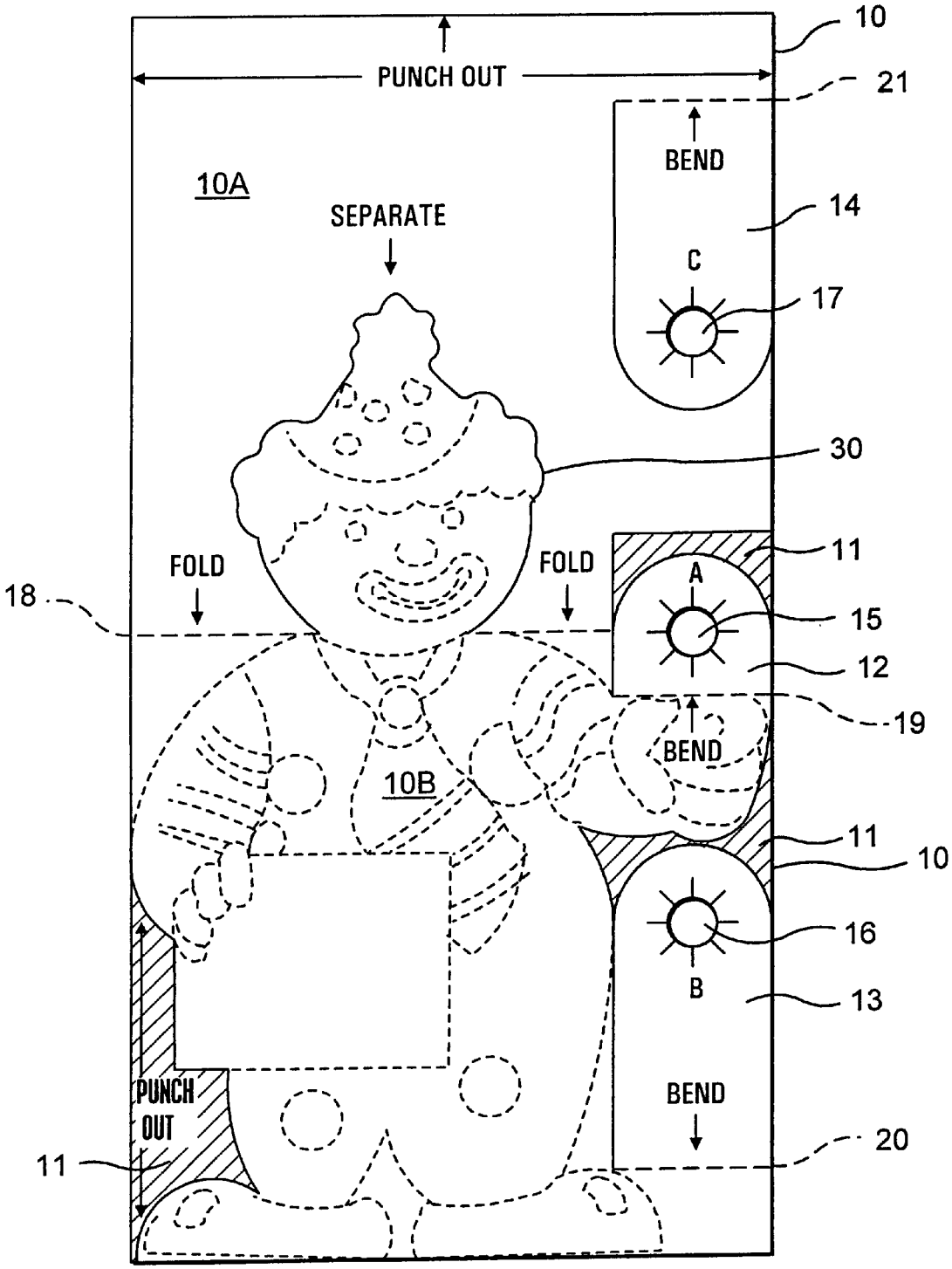
FIG. 1 is a view of a single flat sheet of foldable material foldable into a support device, according to a first embodiment of the present invention.
Figure 2:
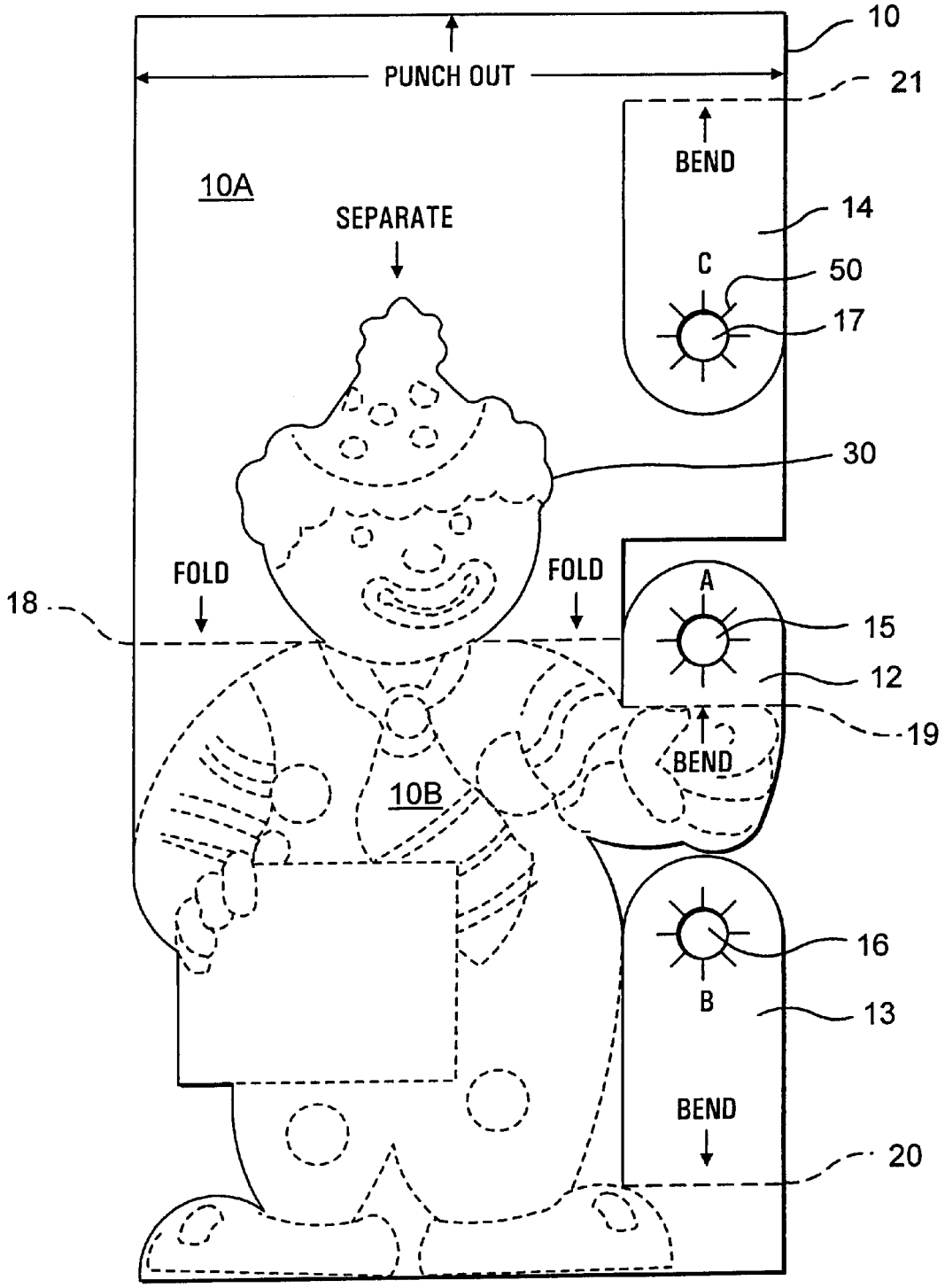
FIG. 2 is a view of the single flat sheet of foldable material according to the first embodiment of the present invention, able portions removed.

With reference now to the drawings, and in particular to FIGS. 1 and 2, there is shown a single, flat sheet or card member 10 of foldable material, preferably but not necessarily made of cardboard, which may have thereon a printed illustration, such as the clown 30. The sheet 10 has an outer predetermined shape, preferably substantially rectangular, and defines at least an upper panel 10A and a lower panel 10B with a foldable panel hinge line 18 therebetween. The sheet 10 may have one or more die-cut inner shapes formed therein as described below. The die-cut inner shapes formed in the sheet 10 define separable margins for each of a plurality of tabular sections or tabs 12, 13 and 14. In this embodiment, the tabs 12–14 are aligned along one side of the sheet 10. Each of the tabs 12–14 has a scored base 19–21, respectively, defining a fold line for the tab. Unusable portions 11 of the sheet 10 may be formed between the tabs and may be stripped or removed and discarded for recycling.

FIG. 2 shows the foldable sheet 10 of FIG. 1 with unusable portions 11 removed. The remaining portions of the sheet 10 may be of any size and shape suitable for holding a vertical member, as recognized by those skilled in the art, without being limited by the shapes, measurements, proportions or angles shown in the drawings.

The tabs 12–14 are provided with respective die-cut holes 15, 16 and 17. Tabs 12–14 include a series of precut slits 50 formed around the periphery of holes 15–17. Slits 50 allow a vertical member to be inserted in holes 15–17 while gripping the vertical member in place. The sheet 10 also has scoring which provide fold indicia, (shown as broken or dash lines), to facilitate horizontal folding at the vertical middle 18 of the sheet 10 and at the respective bases 19, 20 and 21 of each of the tabs 12–14. The fold indicia as well as the cuts defining the separable margins of the tabs 12–14 may be made by pressing, punching, scoring, cutting, perforating, and the like, as desired. The tabs 12–14 are shown with rounded distal ends. However, it will be understood that any configuration that permits substantial alignment of the holes 15–17 upon folding of the sheet elements will suffice. Tabs 13 and 14 are preferably equal in length. However, this is not necessary. That is, it is sufficient if the holes 16 and 17 fall into substantial alignment upon horizontally folding the tabs to the positions shown in FIG. 3.

Figure 3:
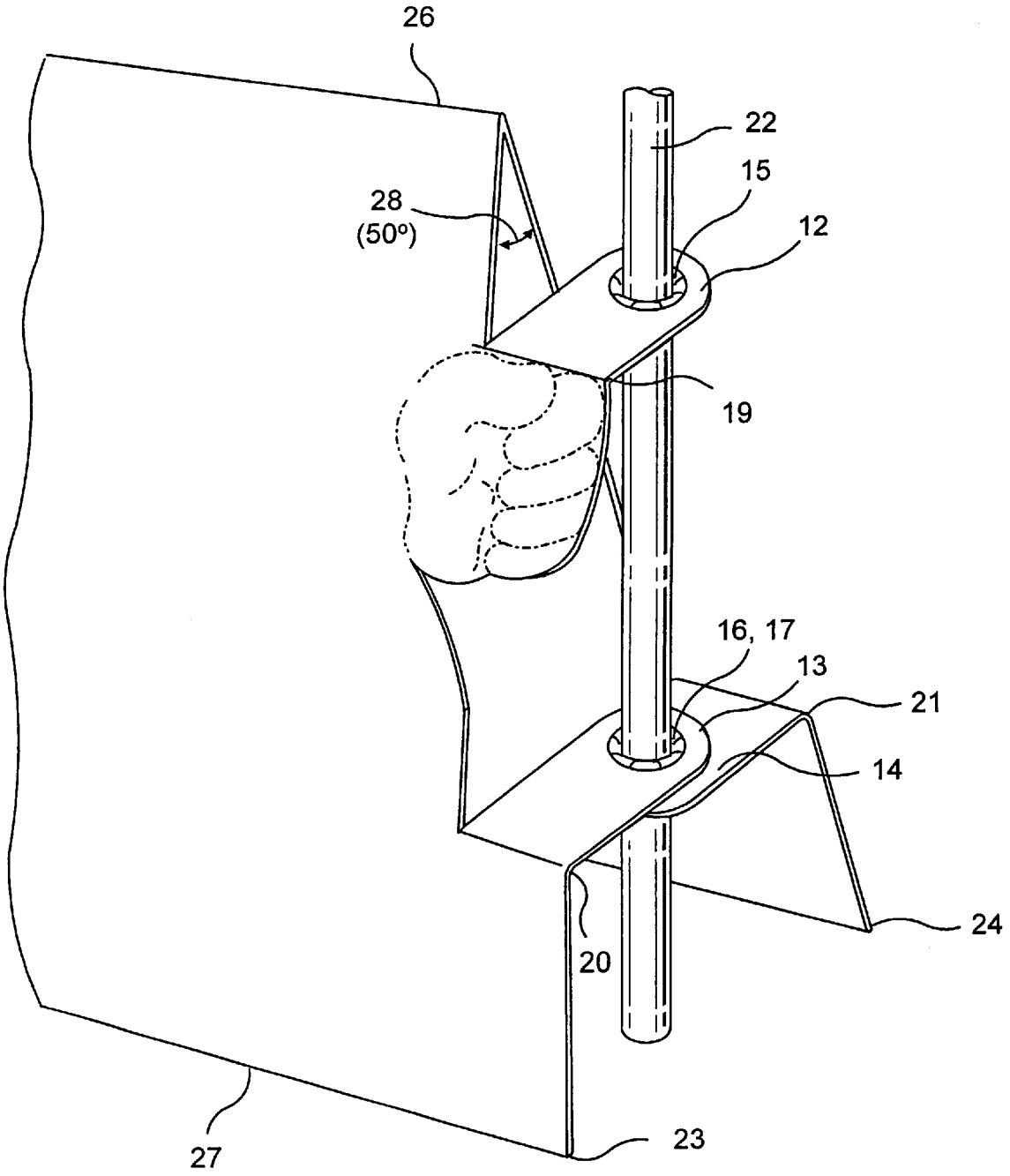
FIG. 3 is a close-up perspective view of an assembled support device according to the first embodiment of the present invention.

Referring now to FIG. 3, there is shown a close-up perspective view of the support device after it has been horizontally folded into a three dimensional A-frame structure. Tabs 12, 13 and 14 are bent at substantially right or 90° angles inward toward the center-line of the A-frame along scored fold lines 19, 20 and 21. Upon folding of the sheet 10 along the fold line 18 to form fold 26, the tabs 13 and 14 are folded inwardly toward each other, with tab 13 falling just above or below tab 14. If the distance between the respective fold lines 20 and 21 and the center of the respective holes 16 and 17 is equal, the vertical member 22 will be centered at the bottom or base of the device upon traversing the aligned holes 15–17. The stability of the structure is optimized by providing the tabs 13 and 14 with a combined length, upon alignment of the holes 16 and 17, that is approximately 80 percent of the vertical height from fold 26 to the center of the base line 27 mid-way between 23 and 24. The resultant angle of the apex 28 of the device is then approximately 50°.

The stability of the vertical member 22, including any sign attached thereto, as well as the stability of the support device itself, are optimized by placing the hole 15 in tab 12 such that when folded as shown in FIG. 3, hole 15 is directly over the overlapping holes 16 and 17 in tabs 13 and 14. In this embodiment, insertion of the vertical member 22 through holes 15, 16 and 17 accomplishes the dual purpose of locking the support device itself in the position shown in FIG. 3 as well as supporting the vertical member 22, and anything attached to the vertical member 22, upright as shown. The vertical member 22 is locked in place at a 90° angle to the base and a 90° angle to any object attached to the top of the vertical member 22.

Figure 4:
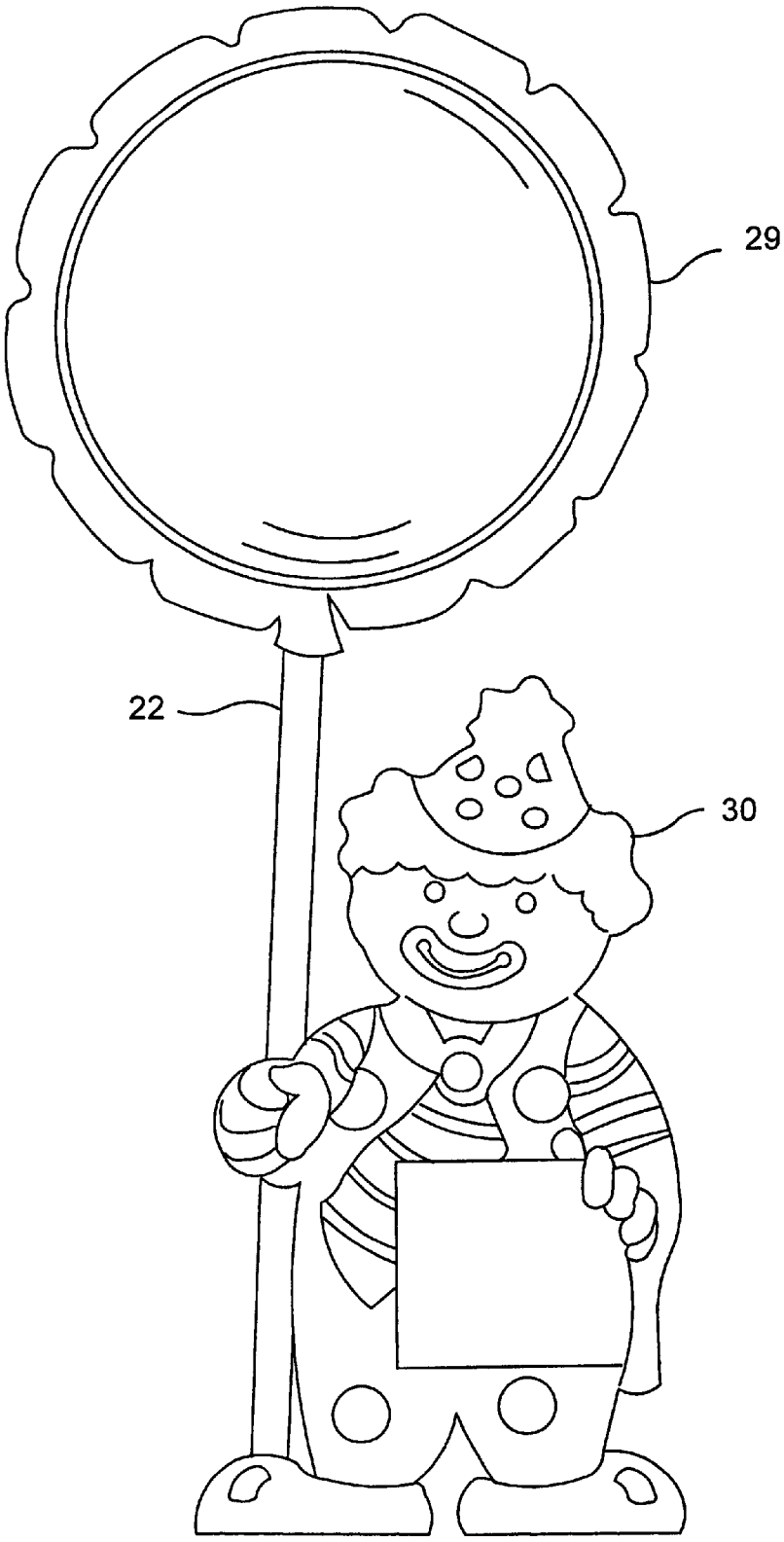
FIG. 4 is a two-dimensional front view of the assembled support device according to the first embodiment of the present invention.

Referring now to FIG. 4, there is shown a two-dimensional front view of the support device locked in place with the vertical member 22 holding a sign 29 attached on top. There is also illustrated the technique of adding perceived height to the support device without additional material, by separating die-cut section 30 from the upper panel 10A and folding it above the attached lower panel 10B. This section 30, (also shown in FIG. 1 and FIG. 2) is preferably placed or positioned and sized carefully in relation to the several functional features to avoid any damage, weakening or compromising of the structural strength and stability of the device support.

Figure 5:
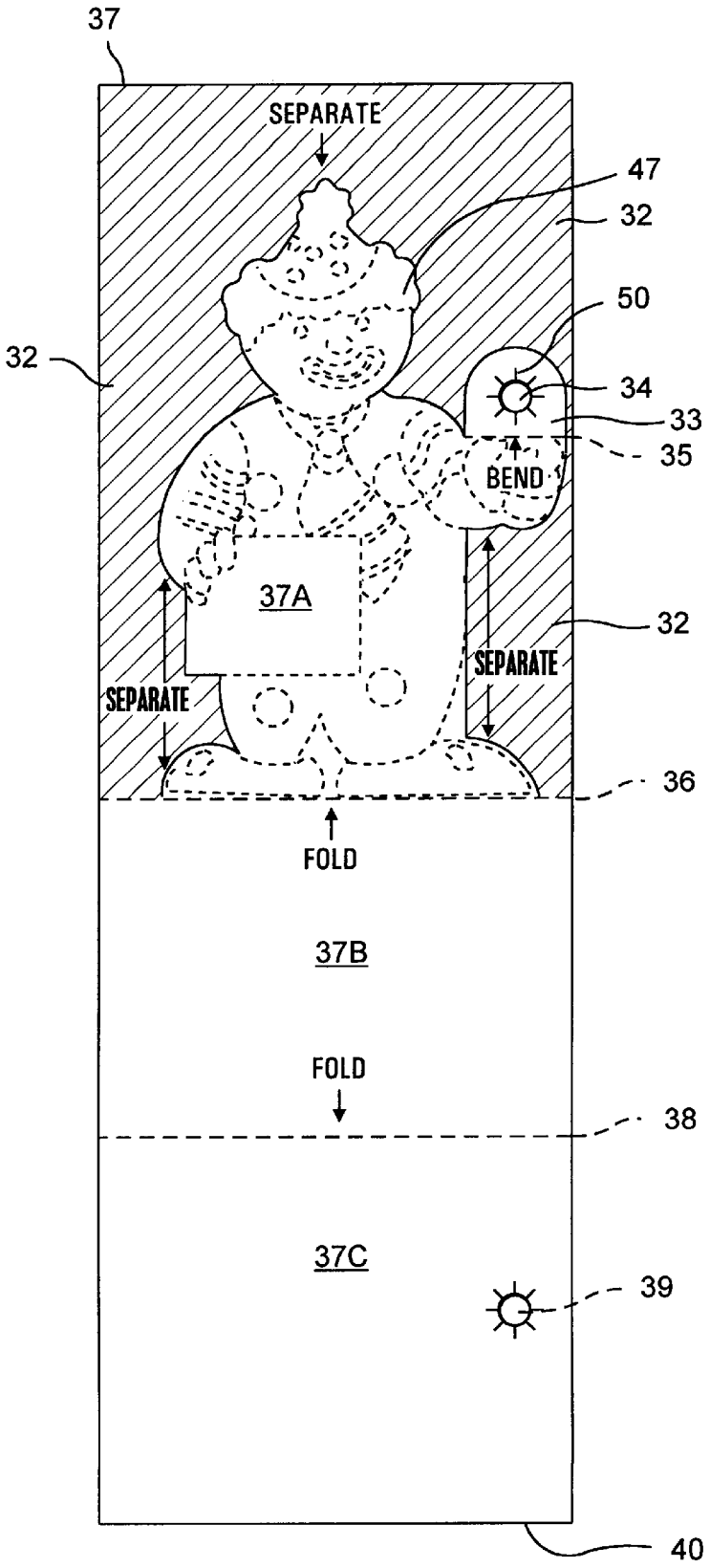
FIG. 5 is view of a single flat sheet of foldable material foldable into a support device, according to a second embodiment of present invention.

A second preferred embodiment of the present invention is shown in FIG. 5. In this embodiment the unassembled support device consists of a sheet or card member 37, which may be formed of cardboard, and which is preferably substantially rectangular in overall configuration. The sheet 37 defines an upper panel 37A, a middle panel 37B and a lower panel 37C. Foldable hinge lines 36 and 38 are formed between panels 37A and 37B and between panels 37B and 37C respectively. A die-cut illustration 47 may be formed on the sheet. The die-cuts separate the usable portions 47 of the original rectangular piece of cardboard 37 from the unusable portions 32, which may be removed and discarded for recycling.

Figure 6:
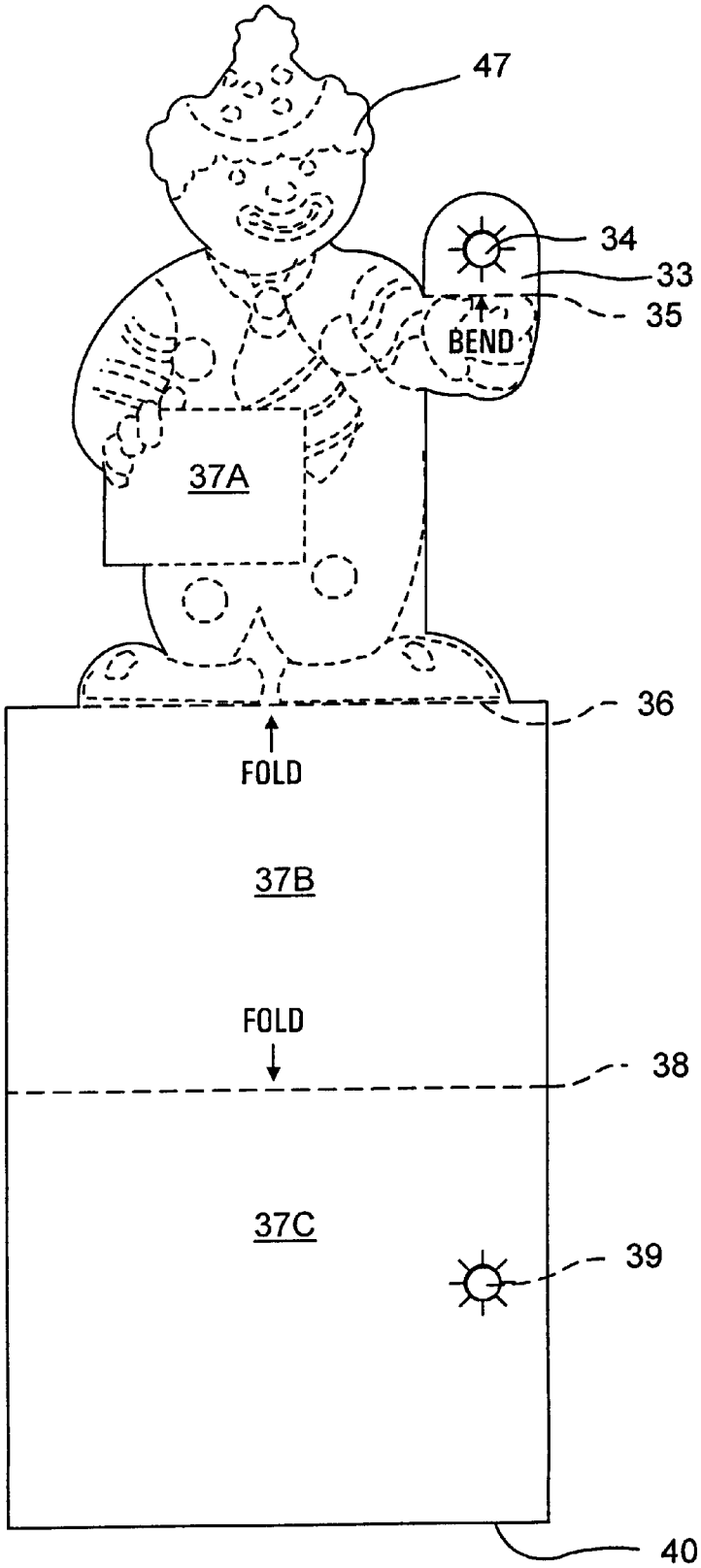
FIG. 6 is a view of the single flat sheet of foldable material according to the second embodiment of the present invention, with unusable portions removed.

With reference to FIG. 6, the usable portion 47 of the sheet 37 includes a tab 33 with a die-cut hole 34 which may include radial cuts 50 to enable the hole 34 to enlarge. A score line 35 defines a foldable hinge line at the base of the tab 33. Additional score lines 36 and 38 define the panels 37A, 37B and 37C. In this embodiment the upper panel 37A is characterized by the shaped clown FIG. 47.

The score line 36 and 38 define foldable hinge lines to facilitate horizontal folding at the base of the shaped FIG. 47, and at approximately one half the distance between the score line 36 defining the base of the shaped FIG. 47 and the bottom edge 40 of the lower panel 37C. A die-cut hole 39 is formed approximately halfway between the horizontal score 38 and the bottom edge of the lower panel 37C and more or less directly in line vertically with the tab hole 34. The various stripping and folding indicia may be made by pressing, punching, scoring, cutting, perforating, and the like. It will be understood that the usable material may be of any size and shape suitable for a vertical member to be held, as recognized by those skilled in the art, without being limited by the shapes, measurements, proportions or angles in the drawings.

Figure 7:
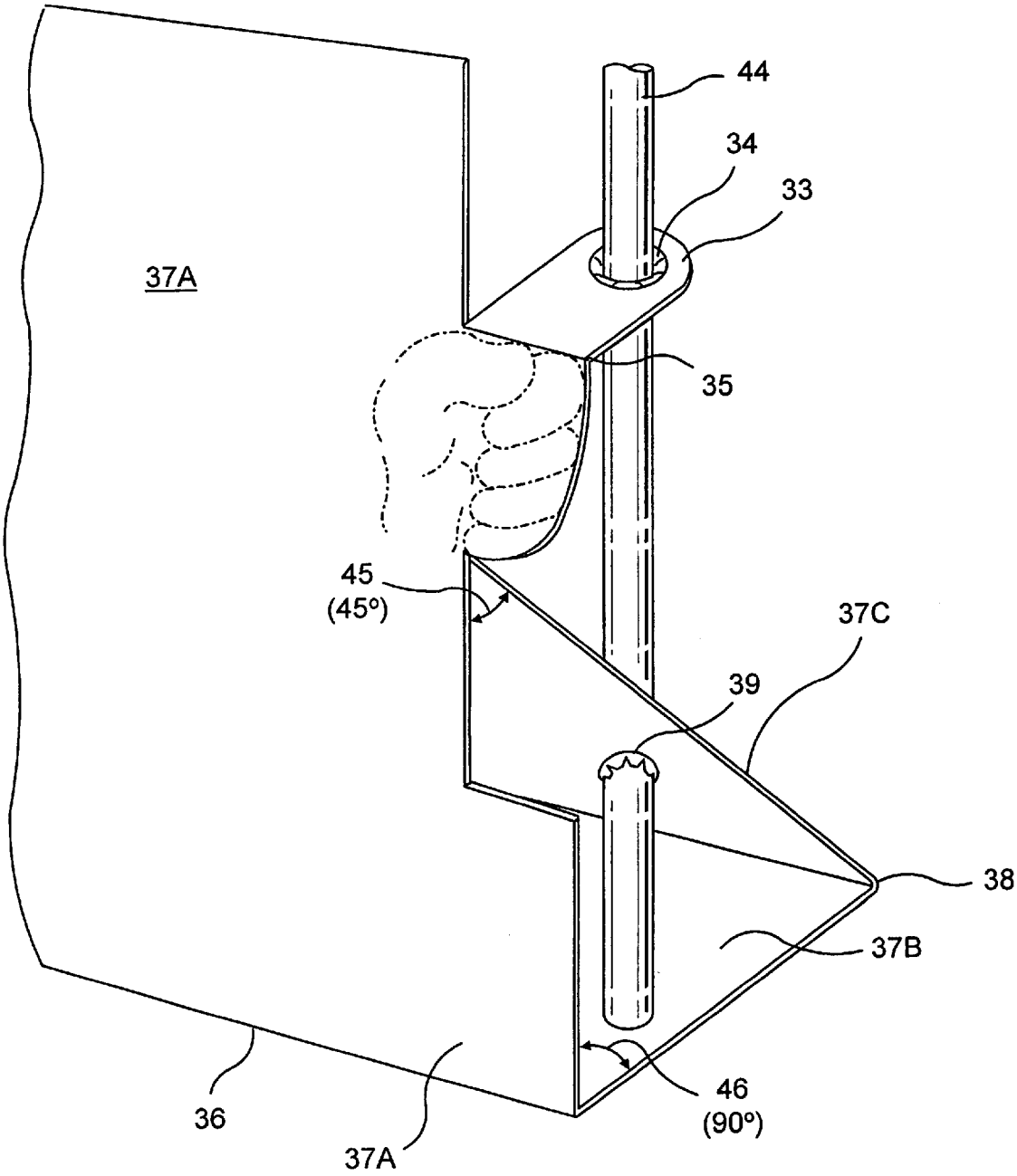
FIG. 7 is a close-up perspective view of an assembled support device according to the second embodiment of the present invention.

Referring now to FIG. 7, there is shown a close-up perspective view of the support device after it has been horizontally folded along the hinge lines as described above. The support device forms an approximate A-frame with the tab 33 bent along score line 35 at approximately a right angle (90°) inward toward the centerline of the A-frame at a preferred position directly above the die-cut hole 39 in panel 37C.

The stability of the device may be optimized by providing the base bottom panel 37B with a distance between the edges formed by folds 36 and 38 that is approximately 100 percent of the vertical height from fold 36 to the center of the tab fold 35. The resultant angle of the apex 45 is approximately 45°. Panels 37A and 37B meet at an angle 46 of approximately 90° with panel 37C forming the hypotenuse of the resultant right triangle. A Vertical member 44 may be passed through the hole 34 formed in the tab 33 and also through the hole 39 formed in the folded panel 37C. When so installed the member 44 then rests on the inside surface of the panel 37B which in this embodiment is folded to define the base of the support device.

While the foregoing parameters and angles are recommended, they are not essential. The desirable result is to center the vertical member 44 over the base 37B of the support device.

It will be appreciated that while the various embodiments of the present invention have been described by reference to specific shapes, dimensions, phrases and terminology, the present invention is not to be limited thereto but is to be defined by the scope of the following claims.

What is claimed is:

1. A support device comprising:

a flexible sheet material foldable to form a three-dimensional two-sided A-frame structure having at least a pair of substantially aligned predetermined holes, one above the other; and an elongated member insertable through the vertically aligned holes so as to maintain the folded flexible sheet material as the three-dimensional two-sided A-frame structure.

2. A support device as recited in claim 1, wherein the flexible sheet material comprises a die-cut and scored piece of material.

3. A support device as recited in claim 1, wherein the flexible sheet material comprises cardboard.

4. A support device as recited in claim 1, wherein the holes are die-cut or pre-punched prior to folding to form the three-dimensional two-sided A-frame structure.

5. A support device as recited in claim 1, wherein the three-dimensional two-sided A-frame structure comprises a retail point-of-purchase display sign support and said elongated member comprises a holder for a display sign.

6. A three-dimensional device for supporting an elongated member comprising:

a single flat piece of foldable, cuttable material, having a predefined shape and including a plurality of tabs and holes, the single flat piece of foldable, cuttable material capable of being folded into a two-sided three-dimensional support form such that at least two of the plurality of holes are aligned, one above the other; and an elongated member insertable into the plurality of aligned holes so as to maintain the single flat piece of foldable, cuttable material in the three-dimensional support form.

7. A three-dimensional device as recited in claims 6, wherein the single flat piece of material comprises a die-cut and scored piece of material.

8. A three-dimensional device as recited in claim 6, wherein the single flat piece of material comprises cardboard.

9. A three-dimensional device as recited in claims 6, wherein the holes are die-cut or pre-punched prior to folding to form the three-dimensional support form.

10. A three-dimensional device as recited in claim 6, wherein the holes are formed within corresponding tabs formed in the single flat piece of material.

11. A three-dimensional device as recited in claim 6, wherein the three-dimensional support form comprises a retail point-of-purchase display sign support and said elongated member comprises a holder for a display sign.

12. A collapsible support device comprising:

a card member having an upper panel and a lower panel, at least one foldable panel hinge line being disposed therebetween;

a tab element formed in one of said upper and lower panels and being foldable outwardly from said panel about a tabular hinge line formed in the card member, said tab element having a tabular hole therethrough substantially at the distal end thereof;

the other of said upper and lower panels being formed with a panel hole whereby, when the card member is folded along said panel and tabular hinge lines said tabular and panel holes are in substantial vertical alignment; and an elongated member insertable into said vertically aligned tabular and panel holes so as to maintain said support device as a three dimensional structure.

13. A support device comprising:

a flexible sheet material foldable to form a three-dimensional two-sided A-frame structure having at least a pair of substantially aligned predetermined holes, one above the other, said holes being formed within corresponding tabular portions of said flexible sheet material; and an elongated element insertable through the vertically aligned holes and supported by the three-dimensional folded structure, said elongated element maintaining the folded flexible sheet material as the three-dimensional two-sided A-frame structure.

* * * * *